United States Patent [19]

Butler

[11] Patent Number: 5,009,346

[45] Date of Patent: Apr. 23, 1991

[54] SLING MOUNTABLE POUCH FOR FIREARMS

[75] Inventor: Ronnie T. Butler, Lakeland, Fla.

[73] Assignee: Peace River Arms & Accessories, Inc., Lakeland, Fla.

[21] Appl. No.: 273,863

[22] Filed: Nov. 21, 1988

[51] Int. Cl.[5] ..... A45C 13/30

[52] U.S. Cl. ..... 224/205; 224/150; 224/236; 206/229; 206/315.11

[58] Field of Search ..... 224/191, 253, 251, 207, 224/149, 150, 913, 264, 219, 222, 202-206, 252, 228, 236, 240; 42/95; 15/104, 165, 104.2; 206/315, 11, 223, 234, 229; 297/482; 280/802

[56] References Cited

U.S. PATENT DOCUMENTS

| | | | |
|---|---|---|---|
| D. 259,220 | 5/1981 | Small et al. | 224/219 |
| 1,274,268 | 7/1918 | Hermann | 150/52 R |
| 2,058,756 | 10/1936 | Ayer | 206/229 |
| 3,262,557 | 7/1966 | Pucci | 224/253 |
| 3,627,181 | 12/1971 | Bianchi | 224/913 |
| 3,931,917 | 1/1976 | Zellmer | 224/205 |
| 4,164,308 | 8/1979 | Gautier | 224/202 |
| 4,299,343 | 11/1981 | Atchisson | 224/913 |
| 4,699,401 | 10/1987 | Saenz | 224/224 |
| 4,756,458 | 7/1988 | Clifton | 224/206 |

FOREIGN PATENT DOCUMENTS

| | | | |
|---|---|---|---|
| 651982 | 10/1937 | Fed. Rep. of Germany | 224/913 |

*Primary Examiner*—Linda J. Sholl

*Attorney, Agent, or Firm*—Warren L. Franz

[57] ABSTRACT

A gun sling mountable pouch suitable for carrying gun cleaning rod sections and accessories has an elongated pocket with a top opening and side flaps extending therefrom that wrap around behind the pocket to form a sleeve-like, tubular opening through which the gun sling may be passed. In a wrap around form of the invention the side flaps have self-fastening material strips that releasably join each other around the sling; in a slide-on version, the flaps are sewn together. In a gun cleaning kit version, cleaning rod handle, tool bits and other accessories are contained in a recloseable tubular plastic vial which slips into the pocket side-by-side with the cleaning rod sections.

9 Claims, 2 Drawing Sheets

SLING MOUNTABLE POUCH FOR FIREARMS

This invention relates to a gun sling mountable pouch for firearms, suitable for carrying gun cleaning tools and the like.

BACKGROUND OF THE INVENTION

Proper care and maintenance of firearms (rifles, shotguns, pistols, etc., hereafter "guns") involves disassembly/reassembly of constituent components and periodic cleaning and oiling. Typical tools utilized for such activities include threaded tubular cleaning rod sections, cleaning rod handle, brush, jag, various screwdrivers and assorted small accessories, oils and solvents. The usual practice when carrying such implements into the field is to carry them loosely or in a separate container that comes as part of a kit. Such storage and transportability of the tools can be awkward, and thus the whole kit, or at least pieces thereof, are often left behind for lack of convenience, or lost.

Sling pouches, as shown in German Patentschrift 651,982 and U.S. Pat. No. 4,299,343, are known for the carrying of hunting licenses, ammunition rounds and the like. Such prior art pouches are unsuitable for carrying cleaning tools and are formed as integral parts of the sling itself. The '982 pouch, for example, is an elongated pouch connected at its ends within the sling to serve as part of the sling support strap portion, the sling being unusable without the pouch attached. In the '343 arrangement, the pouch is integral with a cuff band that fits over a rifle stock to serve as the means of attaching the sling to the rifle.

SUMMARY OF THE INVENTION

The present invention provides a readily attachable and removable sling mountable pouch suitable for storage and field transportability of gun care and maintenance tools.

The pouch comprises an elongated pocket having opposing left and right extensions which wrap around and join each other in sleeve-like fashion to form a tubular opening into which the strap portion of a gun sling can be passed to retain the pouch at a desired convenient position in coaxial alignment on the sling. The pouch has releasable closure means such as a securable flap, to cover a top opening in the pocket. The pocket is dimensioned and configured to snugly receive gun cleaning rod sections, cleaning rod handle and other gun care and maintenance implements therein.

In a preferred wrap-around embodiment, discussed in greater detail below, the side flaps are releasably coupled behind the pocket by means of complementary self-fastening elements secured at extreme edges on opposite faces of the flaps. The pocket closure means also utilizes complementary self-fastening elements, one element secured to the outside of the pocket and the other to a foldable pocket cover flap. Another embodiment of the invention has permanently joined side flaps and slides onto the sling strap, rather than wrapping around it.

The pocket of the pouch is advantageously sized to accommodate substantially the full lengths, side-by-side of a plurality of gun cleaning rod sections and a pocket insertable container in the form of a tubular plastic vial with a reclosable cap is provided for carrying the rod handle and other loose items in an easily and conveniently retrievable manner.

BRIEF DESCRIPTION OF THE DRAWINGS

Embodiments of the invention have been chosen for purposes of illustration and description, and are shown in the accompanying drawings, where in.

Throughout the drawings, like elements are referred to by like numerals.

DESCRIPTION OF THE PREFERRED EMBODIMENT

The principles of the invention will be understood by a reference to the examples of embodiments thereof shown in FIGS. 1-5.

Figure 1:
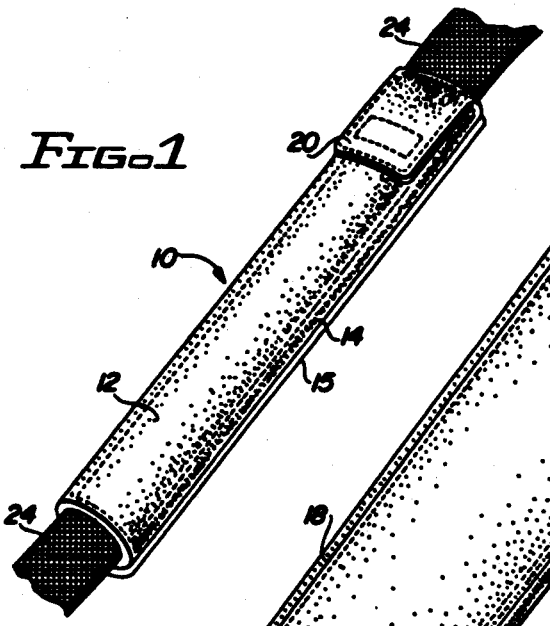
FIG. 1 is a perspective view of an embodiment of the invention shown mounted on a conventional gun sling.
Figure 2:
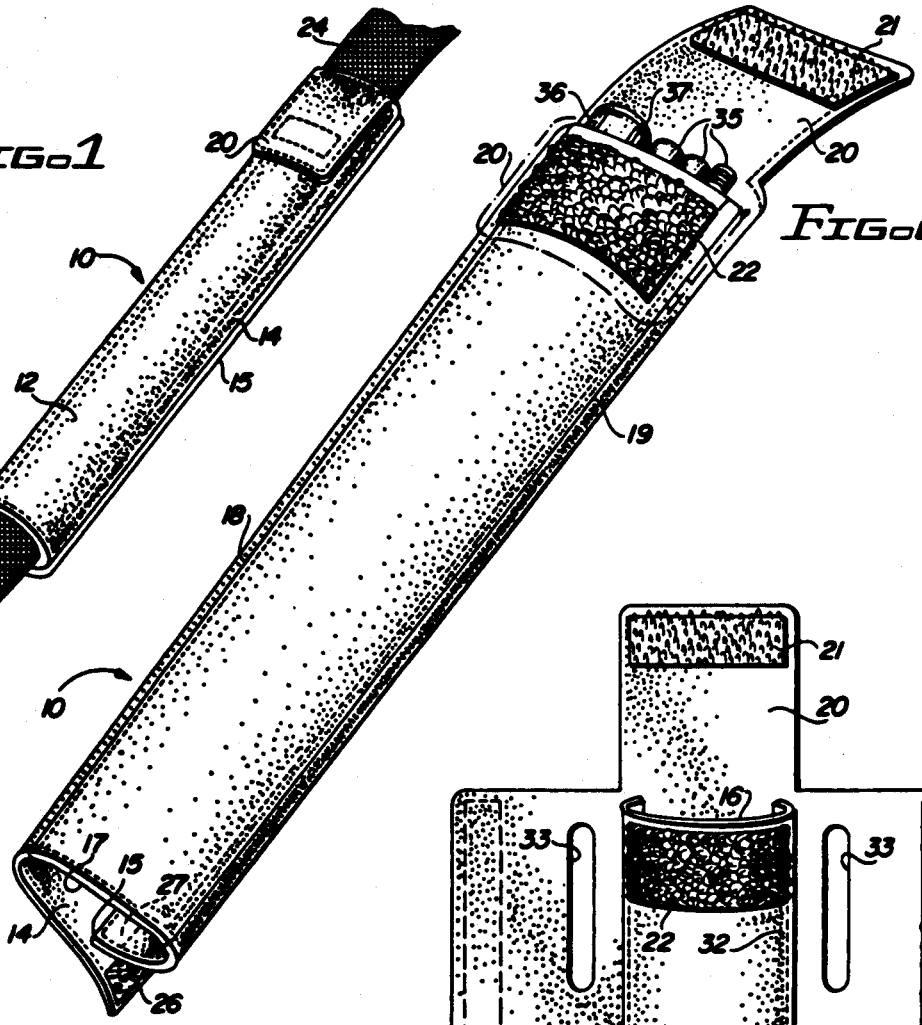
FIG. 2 is an enlarged perspective view of the embodiment of FIG. 1 shown removed from the sling and with the pocket closure flap opened to display possible contents.
Figure 3:
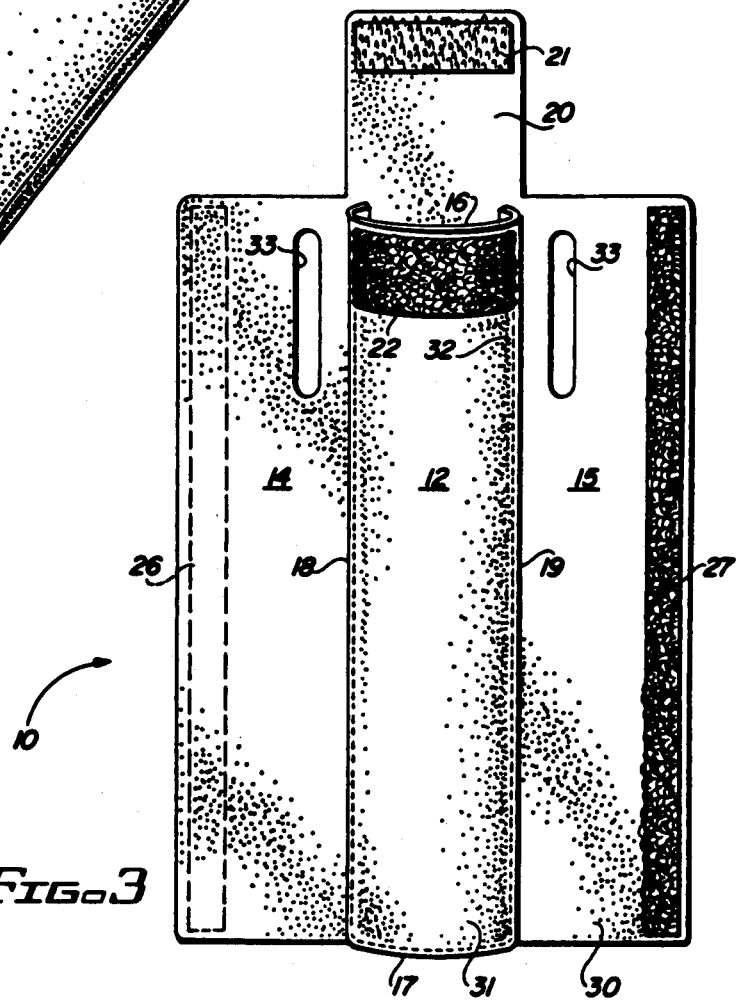
FIG. 3 is a front view of the unwrapped embodiment of FIGS. 1 and 2, showing its construction.

As shown in FIGS. 1-3, a first embodiment of the invention comprises a pouch 10 having an elongated pocket 12 centrally positioned between opposing left and right elongated retaining flaps 14, 15. The pocket 12 has a top opening 16 and closed bottom and sides 17, 18 and 19.

Closure means, in the form of a foldable cover flap 20 is provided at the top of the pocket 12 for releasably closing the opening 16. Closure means such as Velcro TM self-fastener elements 21, 22 or other conventional closure mechanisms are suitable for this purpose. FIG. 2 shows the pouch 10 with the pocket opened (solid line position of cover flap 20) and with the pocket closed (dot-and-dash position of cover flap 20).

The retaining flaps 14, 15 of the pouch 10 run the length of the left and right sides 18, 19 of the pocket 12 and extend sidewise outwardly therefrom a sufficient distance to permit them to be wrapped around behind the pocket 12 (see FIG. 2) in sleeve-like fashion to define a tubular opening through which a strap portion 24 (see FIG. 1) of a gun sling can be passed to removably retain the pouch 10 in coaxial alignment on the sling at a user selected convenient position.

In the embodiment of FIGS. 1-3, the flaps 14, 15 are releasably coupled behind the pocket 12 by means of complementary self-fastening strips 26, 27 (FIG. 3) that run along substantially the full lengths of opposite faces of the flaps 14, 15 adjacent their extreme long edges. FIG. 2 illustrates the manner in which the flap extensions 14, 15 of FIG. 3 wrap around behind the pocket to create the tubular sleeve that envelops the gun sling strap 24.

FIG. 3 illustrates a preferred construction of the pouch 10 made from two rectangular pieces of woven material 30, 31 sewn together along seams 32, as shown. The piece 31 attaches at the center above the front face of the piece 30 to form the pocket 12. The piece 30 is cut with an integral central extension at its top above the placement of the piece 31, which serves as the cover flap 20 for the pocket 12. Strips of self-fastening material, such as Velcro TM self-fastening strips, are sewn along the extreme left edge of the back face and extreme right edge of the front face to provide the flap joinder elements 26, 27. Similar strips are sewn along the top edge of upward extension of the piece 30 and adjacent the top edge of the front face of the piece 31, to provide the pocket flap closure elements 21, 22. One or more belt loop openings 33 may be optionally cut in the flap portions 14, 15 of the material 30, parallel to the elongation of the pocket 12, to provide a user waist belt carrying capability for the pouch 10.

Figure 4:
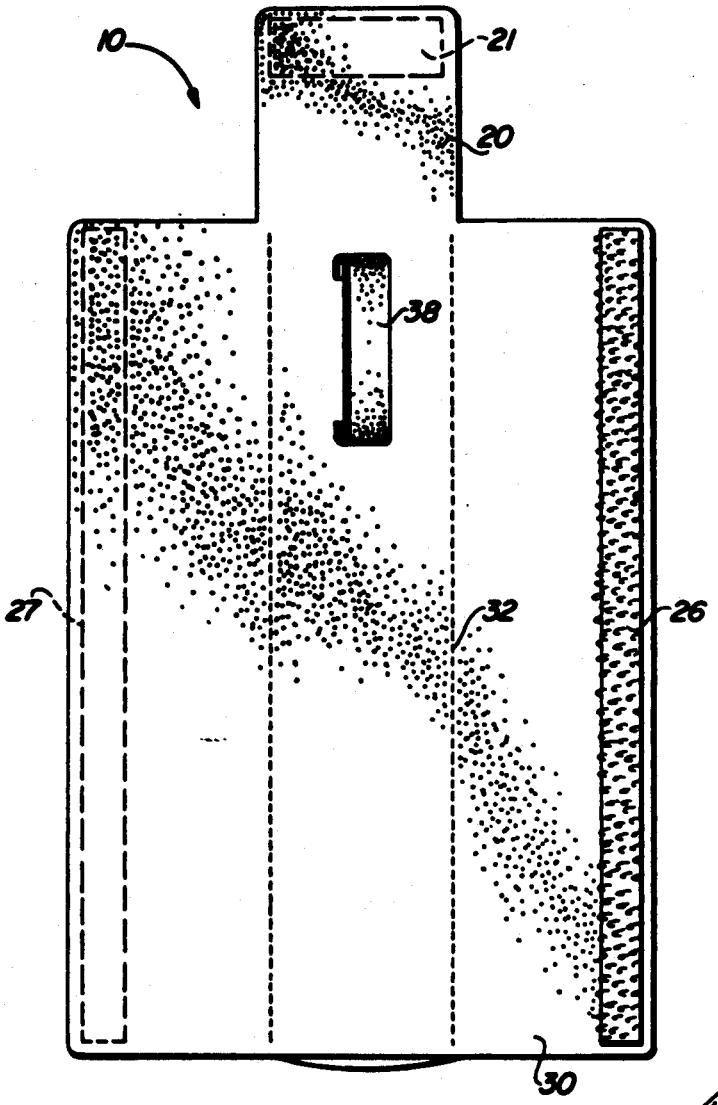
FIG. 4 is a back view of the unwrapped embodiment of FIGS. 1 and 2, showing its construction.

FIG. 4 illustrates a preferred construction of belt loop for pouch 10, made from narrow strips of rectangular material 38 attached to the center back face of piece 30, parallel to the elongation of pocket 12, just below the start of the integral central extension at the top and inside the seams 32.

The length and width of the pocket 12 is advantageously chosen so that the pocket 12 can accommodate a plurality of standard threaded cleaning rod sections 35 and a see-through elongated tubular plastic vial 36 with reclosable cap 37 (shown partially withdrawn from the pocket 12 in FIG. 2) in snug side-by-side arrangement in axially parallel alignment securely within the pouch 10. The vial 36 serves as a conveniently storable/retrievable container for a tool handle 39, a plurality of tool bits, and other gun care and maintenance accessories.

Figure 5:
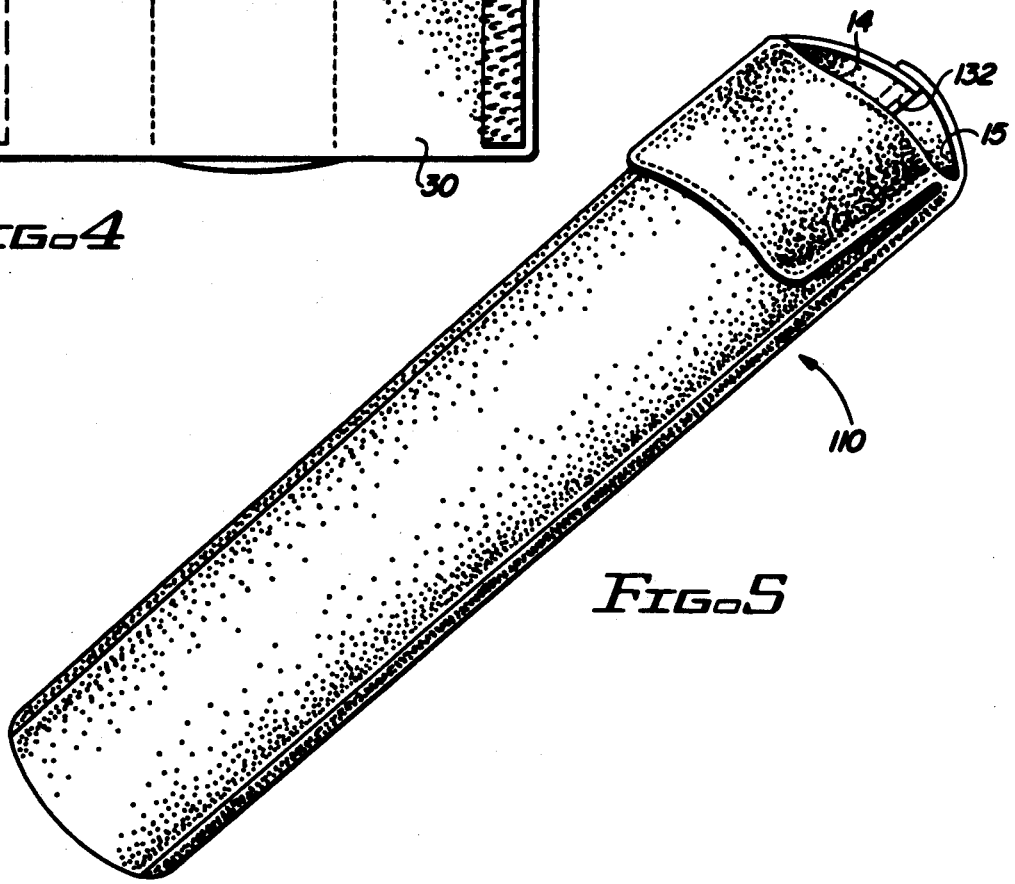
FIG. 5 is a perspective view of a second embodiment of the invention.

FIG. 5 illustrates a second embodiment of the invention in the form of a pouch 110 in which the flaps 14, 15 have been sewn along a seam 132 or otherwise permanently joined to provide a pouch having a tubular opening that slides onto the gun sling strap 24 from one end, rather that wrapping around it as with the foregoing embodiment.

The pouch of the invention, as illustrated by the described embodiments, thus provides a readily attachable and removable, gun sling mountable pouch, capable of securely storing and transporting cleaning rod sections and other gun care and maintenance tools. The mounted pouch is easily and unobtrusively totable on the sling to form a sling carried cleaning kit that is always at hand when needed, without requiring an extra pocket of an extraneous package of which to keep track and from which things can get lost. The pouch provides easy access to cleaning gear at the shooting site when desired; and, when not needed, the pouch stores the gear conveniently out of the way in line with the sling. Putting the pouch on the sling, the rifleman, hunter, soldier or other user has it at hand for simple sight adjustments, probing the barrel to remove obstructions, and/or any one of a number of other events which if not handled promptly can end a day's shooting, not to mention ruining a whole trip. The invention, thus, provides a welcome addition to a gun owner's equipment.

Those skilled in the art to which the invention relates will appreciate that the preferred embodiments of the invention described in detail above are just examples of how the invention can be implemented, and that various substitutions and modifications may be made to the same without departing from the spirit and scope of the invention as defined by the claims below.

What is claimed is:

1. In combination with a firearm carrying sling having a strap portion, a gun cleaning kit mounted on the strap portion, the kit comprising:

at least one firearm cleaning rod section having a length;

a tubular container having a length generally equal to the length of the cleaning rod section; the container containing a cleaning tool handle and a plurality of other gun care and maintenance accessory elements therein, and further having a replaceable top thereon for providing access to the contents of the container;

a pouch comprising a generally rectangular pocket member having a top with an opening, a closed bottom, and left and right sides having lengths generally equal to the length of the cleaning rod section; opposing left and right elongated retaining flaps respectively joined substantially along the full lengths of the left and right sides of the pocket member and having lengths generally equal to the lengths of the pocket member sides; closure means releasably closing the pocket member; and means joining the respective retaining flaps to each other substantially along their lengths to form a tubular opening axially aligned in parallel with the pocket member and receiving the strap portion snugly therethrough to readily removably retain the pouch on the sling in coaxial alignment with the strap portion;

the cleaning rod section and the tubular container being received in side-by-side arrangement substantially within the pocket for removal therefrom through the pocket opening.

2. A kit in combination with a firearm sling as in claim 1, wherein the strap portion of the sling has a width, and wherein the top and bottom of the pocket member have widths generally equal to the width of the sling.

3. A kit in combination with a firearm sling as in claim 1, wherein the means joining the retaining flaps comprises releasably joining means in the form of complementary self-fastening elements respectively located on the left and right flaps.

4. A kit in combination with a firearm sling as in claim 1, wherein the joining means comprises means joining the flaps to each other permanently.

5. A kit in combination with a firearm sling as in claim 1, wherein the cover means comprises a closure flap joined to the pocket member adjacent the top opening, and means releasably joining the cover flap and the pocket member to close the top opening.

6. A kit in combination with a firearms sling as in claim 5, wherein the means joining the cover flap and pocket member comprises complementary self-fastening elements respectively positioned on the cover flap and the pocket member.

7. In combination with a firearm carrying sling having a strap portion, a gun cleaning kit mounted on the strap portion, the kit comprising:

at least one firearm cleaning rod section having a length;

a tubular container having a length generally equal to the length of the cleaning rod section; the container containing a cleaning tool handle and a plurality of other gun care and maintenance accessory elements therein, and further having a replaceable top thereon for providing access to the contents of the container;

a pouch comprising a first generally rectangular piece of woven material having a length generally equal to the length of the cleaning rod section and a width; a second generally rectangular piece of woven material having a length generally equal to the length of the first piece of material and a width less than the width of the first piece of material; the second piece being stitched to a central portion of the first piece to form an elongated pocket having a top with an opening, a closed bottom, and left and right sides having lengths generally equal to the length of the cleaning rod section; portions of the first piece left uncovered by the second piece forming opposing left and right retaining flaps respectively located to the left and right of the pocket member; and complementary strips of self-fastening material respectively secured to opposite faces of the left and right flaps of the first piece substantially along extreme left and right longitudinal edges thereof; the strips being joined together behind the central portion in sleeve-like fashion to form a tubular opening and being wrapped around the strap portion of the sling to readily removably retain the pouch in coaxial alignment with the strap portion; the cleaning rod section and the tubular container being received in side-by-side arrangement substantially within the pocket for removal therefrom through the pocket opening.

8. A pouch as in claim 7, wherein the first piece of material further has an integral upward extension above the central portion which is positioned, dimensioned and configured to form a foldable cover flap for the pocket opening; and further comprising means located on the upward extension and the second piece for releasably closing the pocket opening.

9. A kit in combination with a firearm sling as in claim 7, wherein the strap portion of the sling has a width, and wherein the top and bottom of the pocket member have widths generally equal to the width of the sling.

* * * * *